US011081838B2

(12) United States Patent
Wendt et al.

(10) Patent No.: US 11,081,838 B2
(45) Date of Patent: Aug. 3, 2021

(54) ELECTRICAL CONNECTOR PART HAVING A LOCKING ELEMENT

(71) Applicant: Phoenix Contact GmbH & Co. KG, Blomberg (DE)

(72) Inventors: Andreas Wendt, Berlin (DE); Jens Franke, Bad Pyrmont (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/636,913

(22) PCT Filed: Jul. 30, 2018

(86) PCT No.: PCT/EP2018/070554
§ 371 (c)(1),
(2) Date: Feb. 6, 2020

(87) PCT Pub. No.: WO2019/030035
PCT Pub. Date: Feb. 14, 2019

(65) Prior Publication Data

US 2020/0169038 A1 May 28, 2020

(30) Foreign Application Priority Data

Aug. 8, 2017 (DE) ..... 10 2017 118 014.1

(51) Int. Cl.
*H01R 13/639* (2006.01)
*H01R 13/625* (2006.01)
*H01R 13/629* (2006.01)

(52) U.S. Cl.
CPC ..... *H01R 13/639* (2013.01); *H01R 13/625* (2013.01); *H01R 13/629* (2013.01)

(58) Field of Classification Search
CPC ... H01R 13/639; H01R 13/625; H01R 13/629
(Continued)

(56) References Cited

U.S. PATENT DOCUMENTS 3,470,524 A 9/1969 Culver
3,517,371 A 6/1970 Buckley
(Continued)

FOREIGN PATENT DOCUMENTS

DE 1910073 A 9/1969
DE 102005026148 A1 4/2007
(Continued)

*Primary Examiner* — Peter G Leigh
(74) *Attorney, Agent, or Firm* — Leydig, Voit & Mayer Ltd.

(57) ABSTRACT

An electrical connector part for connecting to a mating electrical connector part includes: a housing that has an insertion portion for making a plug-in connection with the mating electrical connector part, and a locking element, arranged moveably on the housing, for locking the mating electrical connector part to the housing in a locked position, and which is movable out of the locked position in order to release the locking connection between the mating electrical connector part and the housing when in an unlocked position; and a connecting device that connects the locking element to the housing and has a guide portion, a guide element guided at the guide portion, and a spring element, the spring element having a locking leg for latching the guide element to the guide portion in the locked position and/or the unlocked position.

15 Claims, 3 Drawing Sheets

(58) Field of Classification Search
USPC ..... 439/345
See application file for complete search history.

(56) References Cited

U.S. PATENT DOCUMENTS

| | | | | | |
|---|---|---|---|---|---|
| 3,947,081 | A * | 3/1976 | Peterson | H01R 13/193 | 439/261 |
| 4,030,798 | A | 6/1977 | Paoli | | |
| 4,066,315 | A * | 1/1978 | Arneson | H01R 13/622 | 439/311 |
| 4,183,605 | A * | 1/1980 | Arneson | H01R 13/622 | 439/311 |
| 4,277,125 | A * | 7/1981 | Ball | H01R 13/622 | 439/311 |
| 4,284,313 | A * | 8/1981 | Anhalt | H01R 13/6271 | 439/350 |
| 4,478,473 | A * | 10/1984 | Frear | H01R 13/622 | 439/312 |
| 4,542,952 | A * | 9/1985 | Tomsa | H01R 13/625 | 439/318 |
| 4,629,272 | A * | 12/1986 | Mattingly | H01R 13/625 | 439/318 |
| 4,820,185 | A * | 4/1989 | Moulin | G02B 6/3878 | 385/59 |
| 5,145,394 | A * | 9/1992 | Hager | H01R 13/622 | 285/92 |
| 5,256,077 | A * | 10/1993 | Mattingly | H01R 13/625 | 285/396 |
| 5,490,790 | A * | 2/1996 | Okada | H01R 13/4538 | 439/141 |
| 5,662,488 | A * | 9/1997 | Alden | H01R 13/625 | 439/314 |
| 6,162,082 | A * | 12/2000 | Karsten | H01R 13/523 | 439/318 |
| 6,776,638 | B2 * | 8/2004 | Thurston | H01R 13/623 | 439/312 |
| 6,811,423 | B2 | 11/2004 | Yoshigi et al. | | |
| 7,021,669 | B1 | 4/2006 | Lindermeir et al. | | |
| 7,086,886 | B2 * | 8/2006 | Thurston | H01R 13/623 | 439/314 |
| 7,553,177 | B2 * | 6/2009 | Antonini | H01R 13/641 | 439/314 |
| 9,437,965 | B2 * | 9/2016 | Zitsch | H01R 13/622 | |
| 9,450,334 | B2 * | 9/2016 | Haas | H01R 13/64 | |
| 9,477,049 | B2 * | 10/2016 | Gniadek | H01R 13/625 | |
| 2006/0046566 | A1 | 3/2006 | Zemba | | |
| 2011/0318098 | A1 | 12/2011 | Gloaguen et al. | | |
| 2013/0244466 | A1 * | 9/2013 | Cole | H01R 13/639 | 439/312 |
| 2014/0227900 | A1 | 8/2014 | Grinderslev et al. | | |
| 2014/0295690 | A1 | 10/2014 | Quero Pacheco et al. | | |
| 2016/0352044 | A1 * | 12/2016 | Troquet | H01R 13/625 | |
| 2017/0117664 | A1 * | 4/2017 | Yoshigi | H01R 13/633 | |

FOREIGN PATENT DOCUMENTS

| | | | |
|---|---|---|---|
| DE | 102011051302 | A1 | 12/2011 |
| DE | 102012203459 | A1 | 5/2013 |
| EP | 0039640 | A2 | 11/1981 |
| GB | 1113173 | A | 5/1968 |

* cited by examiner

ELECTRICAL CONNECTOR PART HAVING A LOCKING ELEMENT

CROSS-REFERENCE TO PRIOR APPLICATIONS

This application is a U.S. National Phase application under 35 U.S.C. § 371 of International Application No. PCT/EP2018/070554, filed on Jul. 30, 2018, and claims benefit to German Patent Application No. DE 10 2017 118 014.1, filed on Aug. 8, 2017. The International Application was published in German on Feb. 14, 2019 as WO 2019/030035 under PCT Article 21(2).

FIELD

The invention relates to an electrical connector part for connecting to a mating electrical connector part.

BACKGROUND

An electrical connector part of this type comprises a housing with a plug-in portion formed thereon for plug-in connection to the mating electrical connector part. For example, one or more electrical contact elements can be arranged on the plug-in portion, via which electrical contact elements the electrical connector part electrically contacts the associated mating contact elements of the mating electrical connector part when the electrical connector part and the mating electrical connector part are plugged together.

In order to lock the electrical connector part and the mating electrical connector part in a position in which they are plugged together, a locking element is provided which is designed to lock the mating electrical connector part to the housing of the electrical connector part in a locked position. The locking element can be moved out of the locked position in order to release the locking between the mating electrical connector part and the housing in an unlocked position.

Given a plug-in connector known from DE 10 201 1 051 302 A1, a locking ring is arranged on a first connecting element and can be rotated relative to the first connecting element. The locking ring can be screwed onto a second connecting element in order to in this way establish a connection between the connecting elements.

From DE 10 2005 026 148 A1, a plug-in connector is known in which a quick-release locking mechanism is arranged on one coupling half. For this purpose, a rotatable sleeve is arranged on the coupling half, which rotatable sleeve carries leaf spring elements for establishing a locking with another coupling half.

SUMMARY

In an embodiment, the present invention provides an electrical connector part for connecting to a mating electrical connector part, comprising: a housing that has an insertion portion configured to make a plug-in connection with the mating electrical connector part, and a locking element, arranged moveably on the housing, which is configured to lock the mating electrical connector part to the housing in a locked position, and which is movable out of the locked position in order to release the locking connection between the mating electrical connector part and the housing when in an unlocked position; and a connecting device that connects the locking element to the housing and has a guide portion, a guide element guided at the guide portion, and a spring element, the spring element having a locking leg configured to latch the guide element to the guide portion in the locked position and/or the unlocked position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
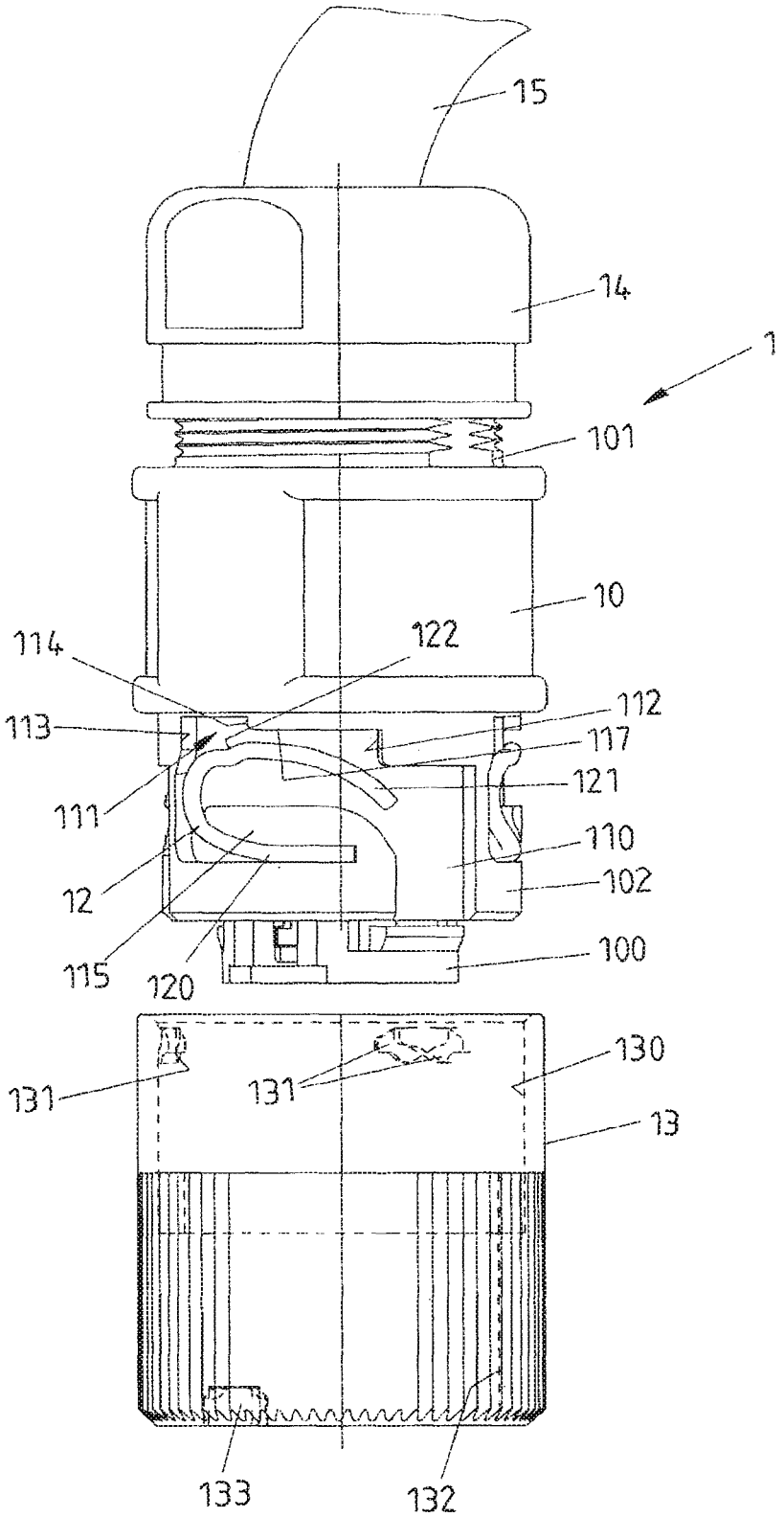
FIG. 1 a view of an exemplary embodiment of an electrical connector part with a locking element arranged on a housing.

In an embodiment, the present invention provides an electrical connector part which has a locking means that is easy to operate, haptically pleasing, and also easy to install.

Accordingly, the electrical connector part has a connecting device which connects the locking element to the housing and has a guide portion, a guide element guided on the guide portion, and a spring element. The spring element comprises a locking leg for locking the guide element to the guide portion in the locked position and/or the unlocked position.

The (movable) connection between the locking element and the housing of the electrical connector part is established by guiding a guide element on a guide portion in cooperation with an elastic spring element. When the locking element is adjusted between the locked position and the unlocked position, the guide element interacts with the locking leg of the spring element so that the adjustment takes place with deflection of the locking leg and with a latching of the guide element relative to the guide portion in the locked position and/or the unlocked position.

Due to the interaction of the guide element with the locking leg and the latching of the guide element relative to the guide portion in the locked position and/or in the unlocked position, given movement of the locking element it is possible to give a user haptic and advantageously also acoustic feedback regarding a position reached during said movement of the locking element. A user can thus directly and unambiguously learn that a certain position of the locking element has been reached, and thus that locking or unlocking has been established.

The guide portion can be arranged, for example, on the housing, for example in the form of a grooved depression formed on a shaft portion of the housing. However, it is also conceivable and possible to arrange the guide portion on the locking element.

If the guide portion is arranged on the housing, the spring element is preferably also arranged on the housing. However, it is also conceivable and possible to arrange the spring element on the locking element (in particular if the guide portion is arranged on the locking element).

The guide element is preferably arranged on the respective other component. If the guide portion is arranged on the housing, the guide element is arranged on the locking element and thus, upon movement of the locking element, will be moved relative to the guide portion formed on the housing. If the guide portion is arranged on the locking element, the guide element is correspondingly formed on the housing.

In one embodiment, the spring element can have a retaining leg via which the spring element is attached to the associated component, that is to say to the housing or to the locking element. The retaining leg can, for example, be curved towards the locking leg and establishes the connection of the spring element to the associated component. The locking leg is freely extended from the retaining leg so that the locking leg can be moved (elastically) relative to the retaining leg and can be deflected in cooperation with the guide element.

In one embodiment, the spring element with its retaining leg and locking leg can form a (general) C shape, for example.

In one embodiment, the guide element slides along the locking leg when the locking element is moved between the locked position and the unlocked position. When the locking element is moved, the guide element thus acts on the locking leg and deflects the latter so that the guide element, pushing aside the locking leg, comes from the unlocked position into the locked position or, vice versa, from the locked position into the unlocked position.

The locking leg can be designed to latch the guide element in both positions, that is to say, in the locked position as well as in the unlocked position, relative to the guide portion so that the guide element is held by the locking leg in a defined position relative to the guide portion in both the locked position and the unlocked position. Due to the interaction with the locking leg, a user receives haptic and optionally also acoustic feedback so that the user directly and unambiguously learns that, for example, the locked position has been reached.

In one embodiment, the guide element can be moved on a guide edge of the guide portion, along a direction of rotation directed about a longitudinal axis. In this instance, the locking element can be rotated relative to the housing, and by rotation of the locking element the guide element slides along the guide edge predetermined by the guide portion, and thus along a defined movement path. The locking leg of the spring element can hereby be designed to press the guide element into contact with the guide edge of the guide portion so that the guide element is pre-tensioned by the locking leg relative to the guide edge, and is thus held in defined contact with the guide edge.

The displacement path of the guide element that is predefined by the guide edge of the guide portion, and along which the guide element can be moved between the locked position and the unlocked position, is preferably limited so that the guide element and thus the locking element can be moved between defined positions. For this purpose, stop faces can be provided on both sides of the guide portion (viewed along the direction of rotation), with which stop faces the guide element interacts in its different end positions. In the unlocked position, the guide element can thus rest against a first stop face; by contrast, in the locked position it rests against a second stop face. The guide portion extends between the stop faces and is thus delimited by the stop faces. In the locked position and in the unlocked position, the guide element, by interaction with the locking leg of the spring element, preferably engages and is additionally in defined contact with an associated stop face so that the guide element and, in addition, the locking element can be adjusted between defined positions.

In one embodiment, a shoulder is formed at the guide edge along which the guide element slides during a movement of the locking element, said shoulder separating from one another portions of the guide edge having different heights (viewed along the longitudinal axis). For example, in the locked position, the guide element can rest against a portion of the guide edge which is set back relative to another portion of the guide edge (viewed along the longitudinal axis). In the locked position, the latching of the guide element relative to the guide portion is thus additionally effected in that the guide element inserts into a recessed portion of the guide edge so that, due to a (slight) axial displacement of the locking element, a user can additionally perceive that the locked position of the locking element has been reached.

The connecting device for connecting the locking element to the housing of the electrical connector part can enable an easy assembly. For assembly, the spring element can thus be easily attached to, for example, the housing of the electrical connector part in order then to mount the locking element by sliding it on the housing. For this purpose, the connecting device can, for example, have an insertion portion which, like the guide portion, takes the form of a groove in the housing of the electrical connector part, for example, and into which the guide element can be inserted in order to bring the guide element into the region of the guide portion. If the guide element is in engagement with the guide portion, the guide element is held in the region of the guide portion by the locking leg of the spring element and cannot be removed from the guide portion without taking further measures, at least not without an intentional release.

The connecting device may comprise one or more guide portions with one or more associated guide elements and one or more spring elements. If the locking element is rotatable relative to the housing of the electrical connector part, guide portions can then be formed circumferentially offset relative to one another around a shaft portion of the housing, each of which guide portions is respectively associated with a guide element of the locking element and a spring element. The connection between the locking element and the housing of the electrical connector part is thus effected via a plurality of guide elements guided on guide portions, and by spring elements associated with the guide portions.

At this point, it should be noted that the locking element may in principle also be movable in a different way relative to the housing, for example by a translational movement. A rotatable arrangement of the locking element on the housing is inasmuch merely one of several possible embodiments.

According to a further aspect, the locking element can establish a locking connection with the associated mating electrical connector part in the manner of a bayonet coupling. For this purpose, the locking element can, for example, have one or more latching elements, for example in the form of projection elements, via which a positive locking with the mating electrical connector part can be established. If the locking element is mounted rotatably relative to the housing and, for example, takes the form of a hollow cylindrical sleeve, one or more latching elements can, for example be formed that project radially inwardly on the inside of the locking element and engage positively with the mating electrical connector part upon insertion of the mating electrical connector part into an insertion opening formed by the locking element and followed by rotation of the locking element.

If a plurality of latching elements is provided on the locking element, they can, for example, be arranged circumferentially offset and uniformly distributed relative to one another on the locking element so as to produce an evenly distributed locking connection between the electrical connector part and the associated mating electrical connector part.

Figure 2A:
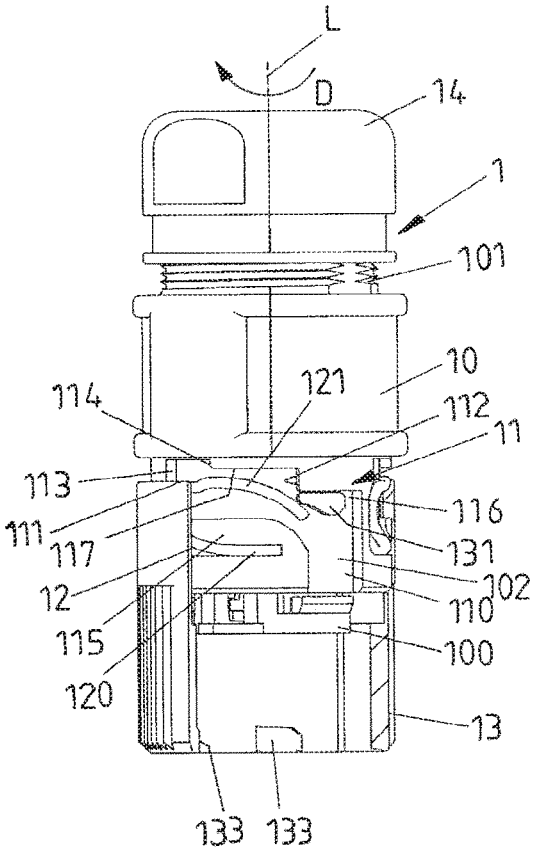
FIG. 2A a view of the electrical connector part during installation of the locking element on the housing.
Figure 2B:
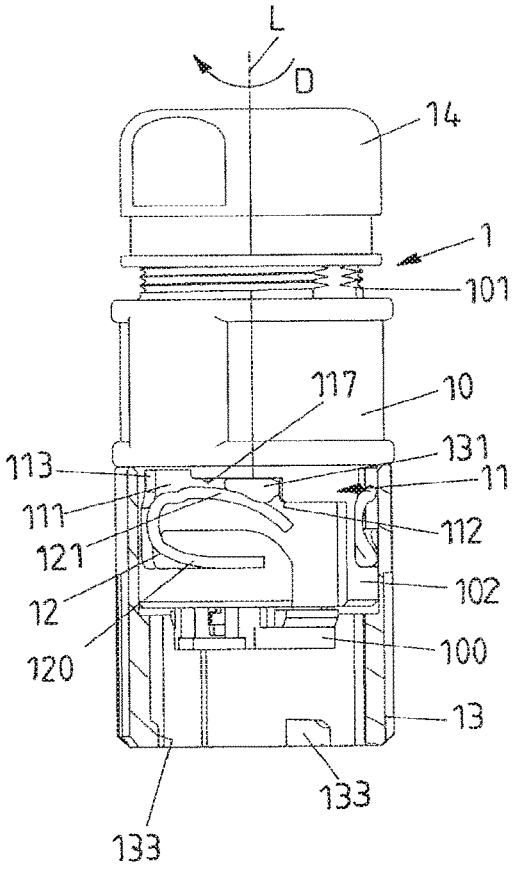
FIG. 2B a view of the electrical connector part in its installed, operational state.
Figure 3A:
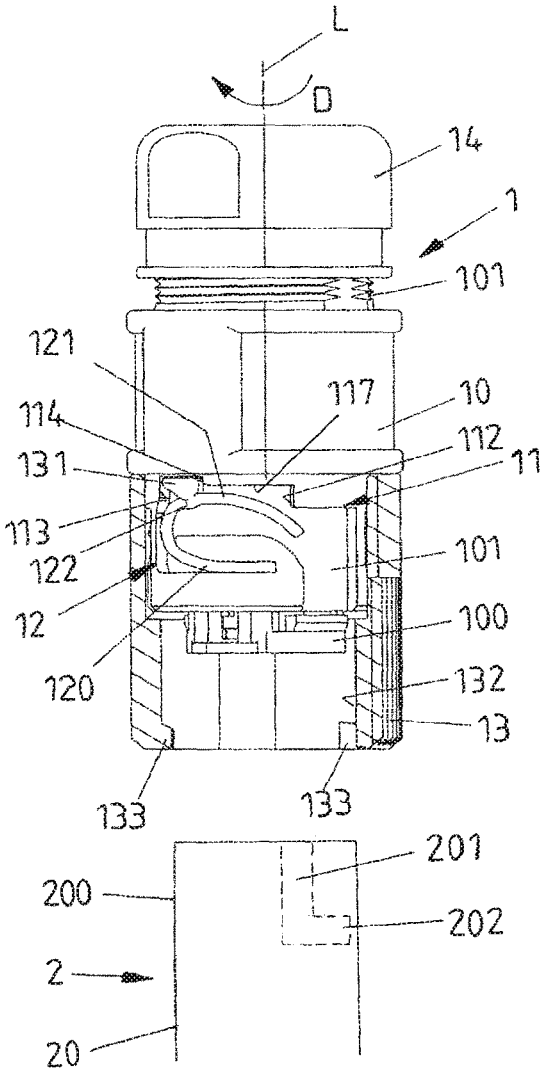
FIG. 3A a view of the electrical connector part in a locked position.

FIGS. 1 to 3A, 3B show an exemplary embodiment of an electrical connector part 1 which serves for (preferably electrical) connection to an associated mating electrical connector part 2 (see FIG. 3A).

The electrical connector part 1 has a housing 10 which has at one end a plug-in portion 100 for a plug-in connection to the associated mating electrical connector part 2, and at the other end a threaded portion 101 on which a threaded element in the form of a union nut 14 is arranged. Via the union nut 14, an (electrical) line 15 connected to the electrical connector part 1 is attached to the housing 10 of said electrical connector part 1 so that it can be tensioned, wherein conductor cores of the line 15 are (electrically) contacted within the housing 10 with contact elements on the plug-in portion 100.

On a shaft portion 102 of the housing 10, a locking element 13 is arranged so as to be able to rotate about a longitudinal axis L along a direction of rotation D. The locking element 13 serves to establish a locking connection between the electrical connector part 1 and the mating electrical connector part 2 when the mating electrical connector part 2 is placed on the electrical connector part 1, such that the connection between the electrical connector part 1 and the mating electrical connector part 2 is secured and the mating electrical connector part 2 cannot be removed from the electrical connector part 1 without releasing the locking connection.

The locking element 13 is rotatably mounted on the housing 10 via a connecting device 11 and can be rotated relative to the housing 10 between defined positions corresponding to a locked position and an unlocked position. For mounting the locking element 13, guide elements 131 inside a receiving space 130 of the locking element 13, said locking element 13 being embodied as a hollow cylindrical sleeve, are inserted into insertion portions 110 in the form of axially extending grooved depressions formed in the circumferential surface of the shaft portion 102, as can be seen in the transition from FIG. 1 to FIG. 2A.

The guide elements 131 on the inside of the locking element 13 thus come into contact with limiting edges 116 of the insertion portions 110 (see FIG. 2A), which limiting edges extend transversal to the longitudinal axis L, and can then, by rotation of the locking element 13 in the direction of rotation D, be introduced into the region of a respective associated guide portion 111 in the form of a groove formed in the shaft portion 102, as shown in FIG. 2B.

Associated with each guide portion 111 is a spring element 12 in the form of a C-shaped leg spring, which is held by means of a retaining leg 120 against a holding portion 115 of the shaft portion 102 and freely extends into the region of the guide portion 111 with a locking leg 121. By rotation in the direction of rotation D, each guide element 131 interacts with the associated locking leg 121 in such a way that, as can be seen in FIG. 2B, the guide element 131 is pressed by the locking leg 121 along the longitudinal axis L into contact with a guide edge 117 of the guide portion 111 and is held thereby in the guide portion 111.

The locking element 13 (rotatable) is thus fixed relative to the housing 10 of the electrical connector part 1 via the guide elements 131 and their retention in the guide portions 111.

If the position according to FIG. 2B, corresponding to the locked position, is reached, the electrical connector part 1 is basically ready for operation (assuming a line 15 has been fabricated) and can be connected to an associated mating electrical connector part 2, in that the mating electrical connector part 2 is inserted into an insertion opening 132 formed by the locking element 13 and, by rotating the locking element 13 in the rotational direction D, is locked into the locked position, as shown in FIG. 3A, with the electrical connector part 1.

On the inside of the insertion opening 132, latching elements 133 in the form of projections projecting radially inwards are formed on the locking element 13, which latching elements 133, upon insertion of the mating electrical connector part 2, for example, slide into insertion portions 201 on the outside of an plug-in portion 200 of a housing 20 of the mating connector part 2 and, by rotation of the locking element 13, respectively come into engagement with an associated locking portion 202 of the plug-in portion 200 of the mating electrical connector part 2 so that a positive locking connection is created between the electrical connector part 1 and the mating electrical connector part 2.

Figure 3B:
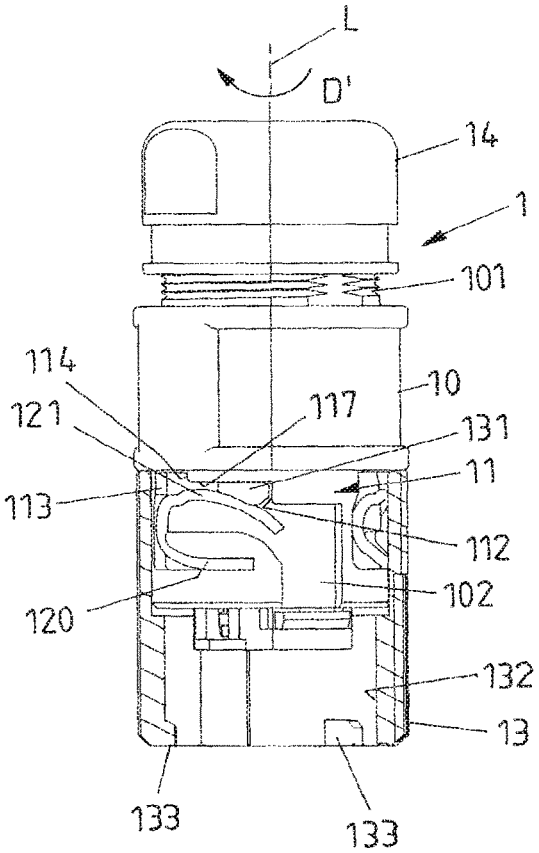
FIG. 3B a view of the electrical connector part in an unlocked position.

FIG. 3A shows the electrical connector part 1 in the locked position, whereas FIG. 3B shows the electrical connector part 1 in the unlocked position. The insertion of the mating electrical connector part 2 takes place while the locking element 13 is in the unlocked position shown in FIG. 3B, so that the latching elements 133 inside the locking element 13 can slide into a respective associated insertion portion 201 on the plug-in portion 200 of the mating electrical connector part 2.

In the unlocked position, the locking element 13 is locked and latched by interaction of the spring elements 12 with the respective associated guide element 131, in that each locking leg 121 presses the guide element 131 associated with it into contact with a stop face 112, which delimits the guide portion 111 on the unlocked position side, and into contact with the guide edge 117.

In order to lock the electrical connector part 1 to the mating electrical connector part 2, the locking element 13 is rotated in the rotational direction D into the position shown in FIG. 3A, whereby each guide element 131 slides along the locking leg 121 of the associated spring element 12 and thus moves along the guide edge 117 of the associated guide portion 111 until the guide element 31 comes into abutment with a stop face 113 of the guide portion 111 on the side of the locked position and slides into a recessed portion of the guide edge 117 on the other side of a shoulder 114 in the guide edge 117, as shown in FIG. 3A. The locked position is thus achieved, and in the locked position the guide element 131 latches again, which again a user can both feel and hear due to the spring action of the locking leg 121, also due to the locking leg 121 having a notch 122 associated with the locked position, with which notch 122 the guide element 131 engages in the locked position, as can be seen from FIG. 3A.

In the locked position, the electrical connector part 1 is locked to the locking portions 202 of the mating electrical connector part 2 via positive engagement of the latching elements 133 of the locking element 13.

In order to unlock the electrical connector part 1 and the mating electrical connector part 2, the locking element 13 can be rotated back in the opposite rotational direction D', as shown in FIG. 3B, whereby the guide element 131 slides across and past the shoulder 114 and, pushing aside the locking leg 121, comes back into the unlocked position and into contact with the stop face 112, as can be seen from FIG. 3B. The guide element 131 in turn latches in the unlocked position due to the spring action of the locking leg 121.

By rotating the locking element 13 back in the direction of rotation D', the latching elements 133 withdraw from the region of the locking portions 202 of the plug-in portion 200 of the mating electrical connector part 2, so that the mating electrical connector part 2 can be pulled out of the insertion opening 132 of the locking element 13 and the insertion portion 200 can thus be brought out of engagement with the insertion portion 100 of the housing 10.

The shoulder 114 is rounded at its edge, for example as can be seen from FIG. 1. The guide element 31 can also be rounded at one edge, with which the guide element 31 slides across and past the shoulder 114 so that the guide element 131 can be moved out of the locked position, across the shoulder 114 in the direction of the unlocked position, without any (great) application of force.

By providing the connecting device 11 using one or more spring elements 12 for a latching arrest of the locking element 13 relative to the housing 10 of the electrical connector part 1 in the unlocked position as well as in the locked position, it is possible to indicate directly and clearly to a user whether the unlocked position or the locked position has been reached. The locking element 13 latches audibly in the locked position and the unlocked position (and only in these positions) so that a user knows when the locked position or the unlocked position has been reached. This facilitates operation and reliably signals to a user that, for example, the locking connection between the electrical connector part 1 and the mating electrical connector part 2 has been correctly established.

The connecting device 11 uses few components and also allows easy installation of the locking element 13 on the housing 10 of the electrical connector part 1. For installation, only the spring elements 12 need to be attached to the shaft portion 102 of the housing 10 in order to then push the locking element 13 along the longitudinal axis L and onto the shaft portion 102, without special measures being required to hold the spring elements 12 on the shaft portion 102.

Due to the elastic embodiment of the spring elements 12, the connecting device is insensitive to tolerances. Due to the elastic deformability of the spring elements 12, tolerances can readily be compensated for.

The idea underlying the invention is not limited to the exemplary embodiments illustrated in the preceding, but rather can in principle be realized in a completely different manner.

An electrical connector part of the type described here can be used to connect quite different assemblies with one another. In particular, an electrical line can be connected to an associated electrical assembly via such an electrical connector part. However, it is also possible to connect other contact elements, for example hydraulic or pneumatic contacts, via such a connector part.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Electrical connector part
10 Housing
100 Plug-in portion
101 Threaded portion
102 Shaft portion
11 Connecting device
110 Insertion portion
111 Guide portion (adjustment path)
112 Stop face
113 Stop face
114 Shoulder
115 Holding portion
116 Limiting edge
117 Guide edge
12 Spring element
120 Retaining leg
121 Locking leg
122 Notch
13 Locking element
130 Receiving space
131 Guide element
132 Insertion opening
133 Latching element
14 Threaded element
15 Electrical line
2 Mating electrical connector part
20 Housing
200 Plug-in portion
201 Insertion portion
202 Locking portion
D, D' Direction of rotation
L Longitudinal axis

The invention claimed is:

1. An electrical connector part for connecting to a mating electrical connector part, comprising:

a housing that has an insertion portion configured to make a plug-in connection with the mating electrical connector part, and a locking element, arranged moveably on the housing, which is configured to lock the mating electrical connector part to the housing in a locked position, and which is movable out of the locked position in order to release the locking connection between the mating electrical connector part and the housing when in an unlocked position; and a connecting device that connects the locking element to the housing and has a guide portion, a guide element guided at the guide portion, and a spring element, the spring element having a locking leg configured to latch the guide element to the guide portion in the locked position and/or the unlocked position, wherein the guide element is configured to slide along the locking leg when the locking element is moved between the locked position and the unlocked position, and wherein upon a movement of the locking element, the guide element is configured to act on the locking leg and deflect the locking leg so that the guide element, pushing aside the locking leg, moves from the unlocked position into the locked position or vice versa.

2. The electrical connector part according to claim 1, wherein the guide portion is arranged on one of the housing and the locking element.

3. The electrical connector part according to claim 2, wherein the spring element is arranged on one of the housing and the locking element.

4. The electrical connector part according to claim 3, wherein the spring element has a retaining leg via which the spring element is attached to the one of the housing and the locking element and from which the locking leg extends.

5. The electrical connector part according to claim 4, wherein the retaining leg and the locking leg together form a C-shape.

6. The electrical connector part according to claim 2, wherein the guide element is arranged on an other one of the housing and the locking element.

7. The electrical connector part according to claim 1, wherein the guide element is movable on a guide edge of the guide portion, along a direction of rotation directed about a longitudinal axis.

8. The electrical connector part according to claim 7, wherein the locking leg is configured to press the guide element into contact with the guide edge of the guide portion.

9. The electrical connector part according to claim 7, wherein the guide portion, viewed along the direction of rotation, is delimited by a first stop face against which the guide element rests in the unlocked position and a second stop face against which the guide element rests in the locked position.

10. The electrical connector part according to claim 9, wherein the guide element is movable along the direction of rotation on the guide portion, between the first stop face and the second stop face.

11. The electrical connector part according to claim 7, wherein the guide edge has a shoulder which separates portions of the guide edge which, when viewed along the longitudinal axis, are arranged at different heights.

12. The electrical connector part according to claim 1, wherein the connecting device has an insertion portion via which the guide element is introducible into the guide portion.

13. The electrical connector part according to claim 1, wherein the locking element has at least one latching element for positive locking with the mating electrical connector part.

14. The electrical connector part according to claim 1, wherein the locking element is configured as a sleeve and is arranged rotatably on a shaft portion of the housing.

15. The electrical connector part according to claim 1, wherein the locking element comprises an insertion opening for insertion of the mating electrical connector part.

* * * * *